United States Patent [19]

Kussy et al.

[11] 4,346,357

[45] Aug. 24, 1982

[54] CURRENT-LIMITING CIRCUIT BREAKER ADAPTER

[75] Inventors: Frank W. Kussy, Randallstown; Gustave E. Heberlein, Jr., Sykesville, both of Md.; Bernard DiMarco, Bellefontaine, Ohio

[73] Assignee: Gould Inc., Rolling Meadows, Ill.

[21] Appl. No.: 104,621

[22] Filed: Dec. 17, 1979

[51] Int. Cl.[3] ..... H01H 77/10

[52] U.S. Cl. ..... 335/16; 335/195

[58] Field of Search ..... 335/16, 195

[56] References Cited

U.S. PATENT DOCUMENTS

| | | | |
|---|---|---|---|
| 3,136,921 | 6/1964 | Dorfman et al. | 335/16 |
| 3,359,485 | 12/1967 | Bühler | 335/16 |
| 3,562,680 | 2/1971 | Ozaki et al. | 335/16 |
| 3,815,059 | 6/1974 | Spoelman | 335/16 |
| 3,946,346 | 3/1976 | Oster et al. | 335/16 |
| 4,071,836 | 1/1978 | Cook et al. | 335/16 |

*Primary Examiner*—Harold Broome

*Attorney, Agent, or Firm*—Harold Huberfeld; Jerome M. Berliner; Bernard Gerb

[57] ABSTRACT

A molded housing contains a pair of cooperating contacts arranged to be magnetically blown open and an arc chute therefor. The contacts are biased closed and there is no mechanism for manually operating or latching open the contacts. The magnetically blown-open contacts are connected in series with respective poles of a conventional circuit interrupter which also has magnetically blown open contacts but which also has manual operating means and latch means for the contact system.

6 Claims, 5 Drawing Figures

CURRENT-LIMITING CIRCUIT BREAKER ADAPTER

BACKGROUND OF THE INVENTION

This invention relates to current-limiting circuit interrupters, and more specifically relates to a novel adapter for a current-limiting circuit interrupter which permits the addition of one or more current-limiting breaks in series with the contacts of a conventional current-limiting breaker.

Current-limiting circuit breakers are well known in which the current in two contact arms flows in opposite directions in order to produce a magnetically derived force on the contacts which tends to separate the contacts when the current is greater than some predetermined magnitude. The contacts are then very rapidly opened against the force of a closing bias even before the contact operating mechanism has had a chance to move.

After the contacts open under the influence of the magnetic forces, the contact operating mechanism will eventually catch up with the contacts and latch the contacts in an open position. During the initial opening of the contacts, the arc drawn between them moves into an arc chamber. The arc voltage between the separating contacts then limits the current flowing through the circuit breaker and thus the fault current, and in most cases the current will be interrupted before the breaker operating mechanism is tripped. The interrupting capacity of such a breaker increases with the arc voltage which is produced.

It is well known that the interrupting capacity of a circuit interrupting system can be increased by adding additional series-connected breaks. Thus, U.S. Pat. No. 3,815,059 in the name of Spoelman discloses a molded case type circuit interrupter in which a first circuit breaker of conventional non-current-limiting type is connected in series with a second circuit breaker which may have current-limiting characteristics. In U.S. Pat. No. 3,815,059, however, both of the circuit breakers are provided with respective latch systems which latch the contacts open. The latches for both devices must then be reset or defeated in order to reclose the circuit breaker. Thus, at least two mechanisms must be operated in order to reclose the breaker with this prior art type of arrangement.

BRIEF DESCRIPTION OF THE INVENTION

In accordance with the present invention, a novel current-limiting contact arrangement associated with a respective arc chute is provided for a conventional current-limiting circuit breaker where the additional contacts are not provided with latch means or with any type of operating mechanism, and are normally biased to a closed condition. The adapter is contained in its own insulation housing which can be integral with the insulation housing of the otherwise conventional circuit breaker, or can be separately housed and capable of connection to a conventional circuit breaker either in the factory or in the field in order to increase the interrupting capacity of an existing circuit breaker.

When the adapter unit is in place, it will provide one or more additional interrupting gaps in series with the main circuit breaker contacts, thereby increasing the interrupting capacity of the circuit breaker. This increase is obtained at relatively low cost since the adapter unit does not have latch means or other complex operating mechanism. Moreover, the combination is simply and easily reset by resetting only the latch and operating mechanism of the conventional circuit breaker.

The contacts of the adapter interrupter are biased closed, preferably by a negative rate contact spring which has initially a higher contact force than the contact force of the main circuit breaker to which it is attached. Thus, the contact system of the adapter can open a short time later than the main contact system but will not reclose before the arc is interrupted. It is, however, possible, if desired, to have the spring characteristics of the adapter contact system identical to those of the main contact system so that the two contact systems open simultaneously and in series with one another to increase the interrupting capacity of the combined unit.

DETAILED DESCRIPTION OF THE DRAWINGS

In the figures, the invention is shown in combination with a unitized motor starter which is shown in detail in U.S. Pat. No. 4,088,973 in the name of Kussy et al, issued May 9, 1978. It will be apparent from the following, however, that the novel adapter of the invention could have been shown in combination with any type of conventional molded case circuit breaker, preferably one which also has current-limiting characteristics. It will also be apparent that the novel adapter of the present invention could be a separately housed component in a molded housing which can be connected to any unit as desired. Preferably, however, the units to which the novel assembly of the invention is connected will be those having operating mechanisms and latches for opening a pair of contacts and maintaining the contacts open in series with the normally biased closed contacts of the invention adapter.

Figure 4:
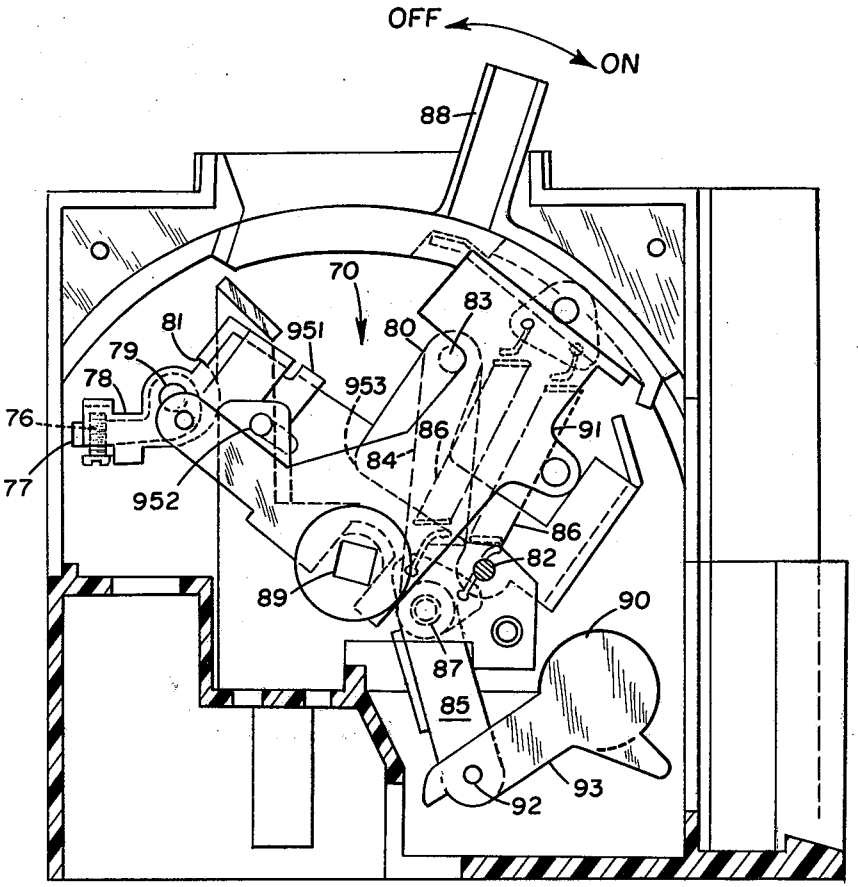
FIG. 4 is a cross-section taken through lines 4—4 of FIG. 1, looking in the direction of arrows 4—4 and showing the elements of the circuit breaker manual operating mechanism in contact closed position.

First describing the unitized combination prior starter 20 of the figures and of above U.S. Pat. No. 4,088,973, it will be noted that the unitized combination motor starter 20 includes a molded insulating housing consisting of base 21 and removable shallow cover 22 secured in operative position by screws 19. Cover 22 includes longitudinally extending parallel ribs that mate with similar ribs 24, 25, 26 in base 21 to form elongated parallel compartments. Three of these compartments have current-carrying elements identical to those illustrated in the right-hand portion of FIG. 2, and constitute a pole of the three pole circuit breaker portion 59 of starter 20. Removable side cover 67 is provided for the compartment which encloses spring powered trip free contact operating mechanism 70 of FIG. 4.

Figure 2:
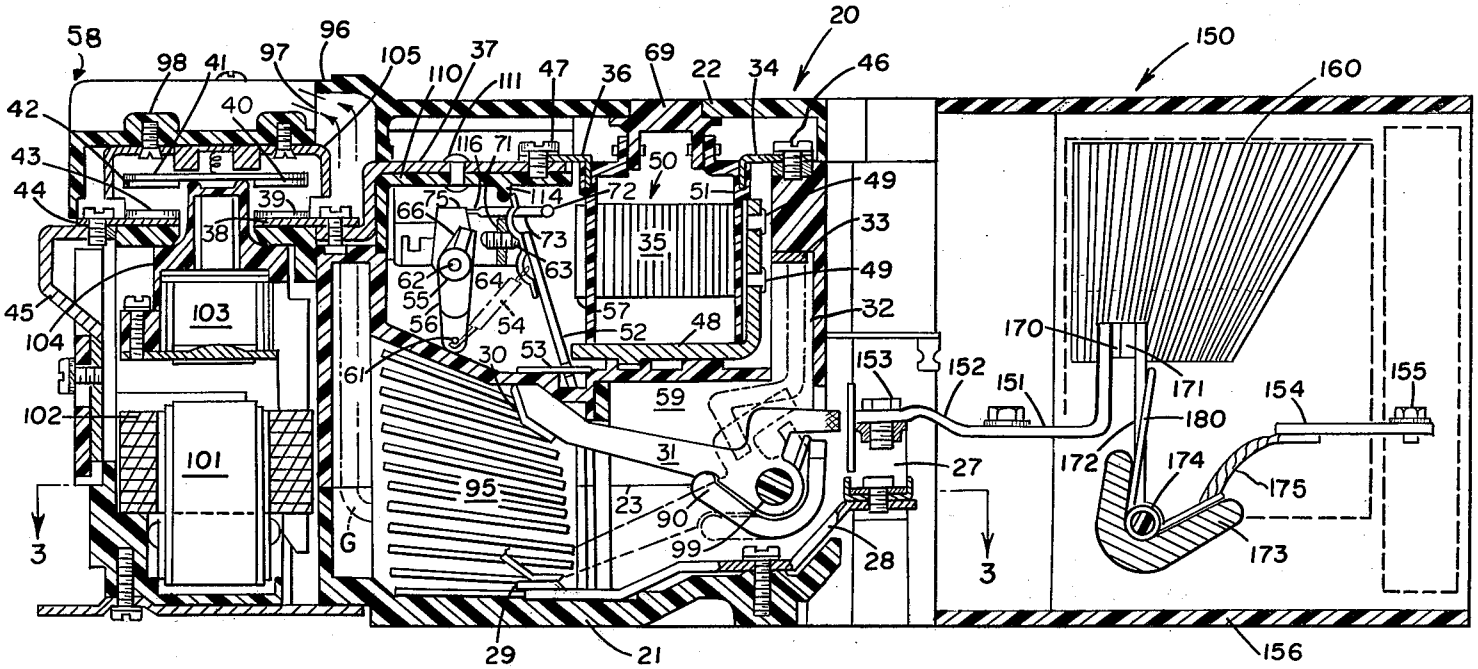
FIG. 2 is a cross-section taken through lines 2—2 of FIG. 1 looking in the direction of arrows 2—2 and showing the elements of one pole unit including the novel adapter of the present invention.
Figure 3:
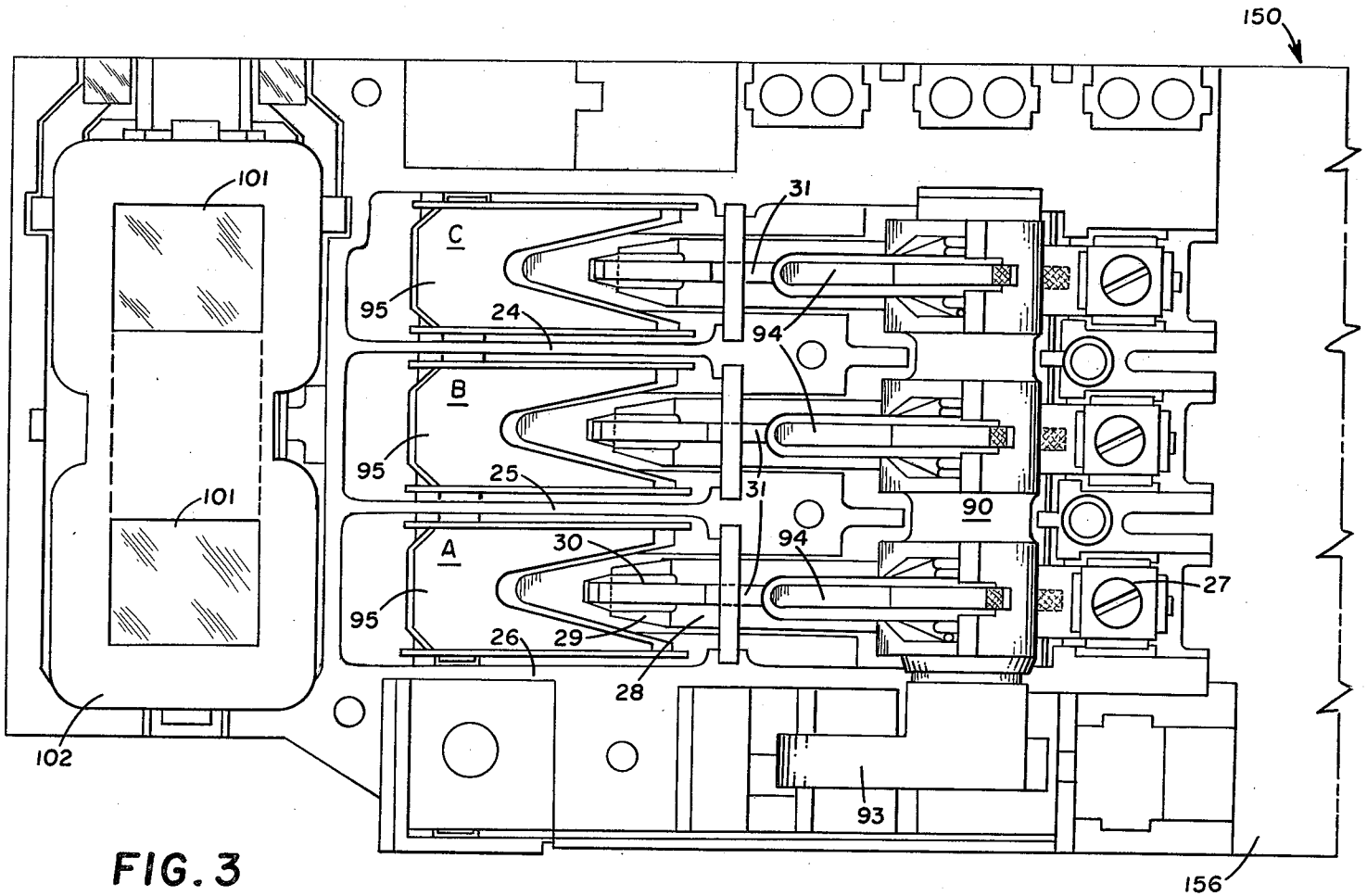
FIG. 3 is a cross-section taken through lines 3—3 of FIG. 2 with the circuit breaker contacts closed, looking in the direction of arrows 3—3.

The current carrying path for each pole A, B, C of starter 20 is identical so that only one of these paths shall be described with particular reference to FIG. 2. This current path includes wire grip 27 at one end of line terminal strap 28, strap 28, stationary contact 29 at the other end of strap 28, movable contact 30 at one end of contact arm 31, arm 31, flexible braid 32 at the other end of arm 31, U-shaped strap 33, coil terminal 34, coil 35, the other terminal 36 for coil 35, conducting straps 37 and 38, stationary contact 39 of electromagnetic contactor portion 58 of starter 20, movable contactor contact 40, conducting bridge 41, movable contactor contact 42, stationary contactor contact 43, conducting strap 44, and load terminal strap 45. The latter is constructed so as to be connectible directly to a load or to be connectible to a load through a conventional overload relay (not shown).

Figure 1:
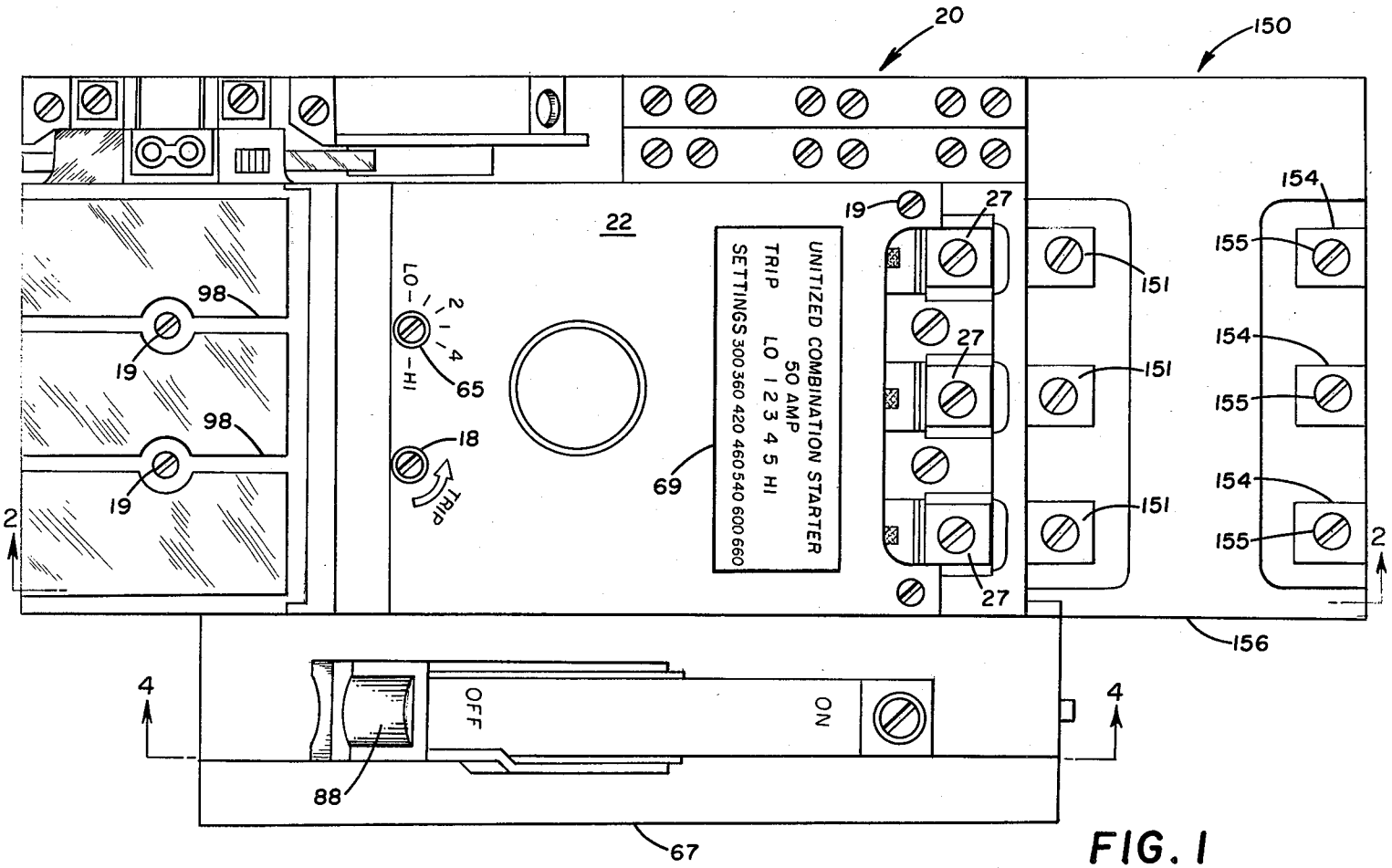
FIG. 1 is a plan view of the novel adapter of the present invention connected to a known type of unitized combination motor starter.

Coil 35 is part of circuit breaker calibrating assembly 50 removable and replaceable from the front of starter 20 after front cover 22 is removed. The calibrating assemblies 50 of all three poles may be individual units or they may be connected to a common insulating member 69 (FIG. 1) so that all three assemblies 50 must be removed as a unit.

Each subassembly 50 is electrically and mechanically secured in operative position by a pair of screws 46, 47 that are accessible when cover 22 is removed from base 21. Coil 35 is wound about bobbin 57 that surrounds one leg of stationary C-shaped magnet frame 48. The latter is secured by rivets 49, 49 to insulator 51 having terminal 34 and bobbin 57 mounted thereto. The magnetic frame also includes movable armature 52 which is pivotally mounted at its lower end in the region indicated by reference numeral 53 so that the upper end of armature 52 may move toward and away from stationary frame portion 48. Coiled tension spring 54 is connected to pin formation 61 at the free edge of radial extension 56 on adjusting bar 55. The latter is pivoted on pins 62 so that spring 54 biases the upper end of armature 52 away from magnetic frame 48. The air gap adjustment between armature 52 and frame 48 is set by screw 63 which is threadably mounted to traverse member 64. A cam (not shown) at the rear of pivotable adjusting control 65 engages extension 66 of member 55 to adjust the tension on all three springs 54 without changing the air gaps between any of the armatures 52 and their associated stationary frame sections 48. Control 65 extends through and is journalled for movement within an aperture of an auxiliary cover 110. Turn-to-trip control 18 extends through and is journalled for movement within an aperture of auxiliary cover 110. Both controls 65 and 18 are accessible for operation through apertures in main cover 22.

Upon the occurrence of predetermined fault current conditions, the flux generated by current flowing in coil 35 attracts armature 52 to stationary frame 48 causing bifurcated armature extension 71 to engage enlarged formation 72 on transverse extension 73 of common tripper bar 75. This pivots the latter clockwise about an axis which coincides with axis 62 for adjusting bar 55 which causes screw 76 on tripper bar extension 77 to pivot latch member 78 in a clockwise or tripping direction about its pivot 79, thereby releasing latching point 81 of latch plate 951 on pivot 952 thereby releasing latching point 953 of cradle 80 so that the latter is free to pivot clockwise about pivot 82. As cradle 80 pivots counterclockwise, end 83 of upper toggle link 84 moves up and to the right with respect to FIG. 4 permitting coiled tension spring 86, connected between toggle knee 87 and manual operating handle 88, to collapse toggle 84, 85 and move handle 88 to the left. The latter is pivoted about center 89 through a connection between handle 88 and its rearward extension 91.

The lower end of lower toggle link 85 is pivotally connected at 92 to the free end of radial extension 93 of contact carrier 90. This causes carrier 90 to pivot clockwise with respect to FIG. 4 and by so doing moves the contact arms 31 of all three poles to the solid line or open circuit position of FIG. 2. It is noted that in the closed position of circuit breaker portion 59 an individual torsion spring 94, interposed between carrier 90 and movable contact arm 31, biases arm 31 counterclockwise about insulating rod 99 as a center and thereby generates contact pressure.

For each pole A, B, C an individual parallel plate arc chute 95 is provided to facilitate extinction of arcs drawn between circuit breaker contacts 29, 30 upon separation thereof. Arcing gases exiting from arc chute 95 at the left thereof with respect to FIG. 2 migrate forward as indicated by the dash lines G and are directed by hooded portion 96 of cover 22 to exit through opening 97 and flow to the left with respect to FIG. 2 in front of contactor section 58. External cover barriers 98 serve to prevent direct mixing of arcing gases from different poles at the instant these gases leave housing 21, 22 through exit openings 97.

The electrical and magnetic elements of contractor 58 are generally of conventional construction and include U-shaped magnetic yoke 101 whose arms are surrounded by portions of coil 102. When the latter is energized, armature 103 is attracted to yoke 101 and carries contact carrier 104 rearward. The latter mounts the bridging contacts 41 of all three poles so that contacts 41 move to their closed position wherein movable contacts 40, 42 engage the respective stationary contacts 39. 43. Steel elements 105 mounted to the inside of cover 22 are positioned in the regions of the contactor contacts 39, 40, 42, 43 whereby extinction of arcs drawn between these contacts upon separation thereof is facilitated through magnetic action.

Rivet 111 (FIG. 2) secures conducting strap 37 on the forward surface of insulating cover 110 of L-shaped cross-section. The latter forms the forward boundary for chamber 112 wherein common tripper bar 75, adjusting bar 55 and armatures 52 are disposed. After the removal of main cover 22, auxiliary cover 110 is removable for access to adjusting screws 63. The rear surface of cover 110 is provided with protrusions 114 which engage and guide movement of extension 73. The latter is flexibly mounted to trip bar 75 at resilient reduced cross-section area 116 which is constructed to bias extension 73 forward. It is noted that base 21 is a multipart unit having sections which mate along dividing line 23 so that the reduced diameter bearing portions of contact carrier 90 may be inserted and captured in operative positions.

In accordance with the present invention, an additional housing device is provided for the current-limiting circuit breaker described above. One pole of the auxiliary device 150 is shown in detail in FIG. 2 and it will be apparent that each pole will be identical and will be associated with a respective pole of the circuit breaker. The pole illustrated in FIG. 2 includes a separate terminal conductor 151 connected to the wire grip 27 of the circuit breaker 20 by conductive bar 152 (shown only in FIG. 2) which is connected to the grip 27 by the screw 153. A second set of terminals including terminal conductor 154 terminated by connection screw 155 is provided at the free end of the adapter housing 156.

The adapter housing 156 can be an integral part of the base 21 or can be a separate component which is suitably connected to the base. The terminal straps 151 and 154 are suitably fixed relative to the base molding 156. Note that the base 156 can have a shallow lid similar to the cover 22 of the circuit breaker in order to permit access for adjustment and inspection of the components within the adapter 150.

A respective arc chamber 160 is provided for each pole of the adapter and cooperates with the respective contact pairs of the adapter. Each of the arc chambers for each pole can be separated by suitable baffles.

The arc chamber 160, which can be similar to the arc chamber 95 of the main circuit breaker, cooperates with contacts including a relatively stationary contact 170 which is supported on the upwardly directed end of terminal strap 151 and a movable contact 171 which is connected to the movable contact arm 172. Movable contact arm 172 is secured to contact carrier 173 which is rotatable about the common insulating rod 174 which serves as a stationary pivot point for contact arm 172. Contact arm 172 is then electrically connected by the flexible conductive pigtail 175 to the terminal 154.

Contacts 170 and 171 are shown in their engaged position in FIG. 2. The contacts are normally biased to this engaged position by a torsion contact spring 180 which is provided for the contacts of each pole of the adapter 150. The torsion contact spring has a higher contact force than that applied to the movable contact arm 31. The contacts 170 and 171 are also subject to an opening force due to the configuration of the terminal bar 151 and contact arm 172 which define parallel but opposite current paths for a substantial distance, thus producing a magnetic opposing force between conductors 170 and 172 which leads to the magnetic opening of the contacts 171 when the current through the circuit breaker is greater than some value sufficient to overcome the biasing force of spring 180. Preferably, contacts 170 and 171 blow off at a time slightly later than contacts 29 and 30 blow off.

In operation, assume the contacts 170 and 171 are normally closed and that the main contact 31 is also closed. If now there is a fault current, contact arm 31 will immediately be forced open and will begin to exert a current-limiting force on the current through the breaker. At a slightly later time, due to the higher spring constant of the spring 180, the contacts 170 and 71 will be forced to open to define a second gap in series with the separating contacts 29 and 30. Thus, an additional arc voltage is produced in series with the circuit being interrupted due to the arc between contacts 170 and 171 and in the arc chamber 160. Once the arc current is interrupted, the latching mechanism associated with the conventional circuit breaker mechanism will latch open the contact arm 31 but the spring 180 will cause the contacts 170 and 171 to reclose without need for reset or the defeat of any latch mechanism. Thus, the entire interrupter assembly can be latter reclosed by a suitable operation of the single handle 88.

The spring 180 in FIG. 2 was sufficiently strong to delay the opening of contacts 170 and 171 to avoid the possibility of reclosing contacts 170 and 171 before the arc is interrupted. However, the contact mechanisms can be designed such that contacts 29 and 30 and contacts 170 and 171 open at the same instant.

The arrangement shown in FIG. 2 is preferably used with a circuit breaker which has blow off type contacts as disclosed. Note that if the circuit breaker did not have blow off type contacts, the operation of the adapter contacts could cause a restrike of the arc across the main circuit breaker contacts.

The novel adapter of the invention could take forms other than that shown in FIG. 2 and, moreover, a plurality of such adapters could be connected in series with one another to produce additional series breaks.

Figure 5:
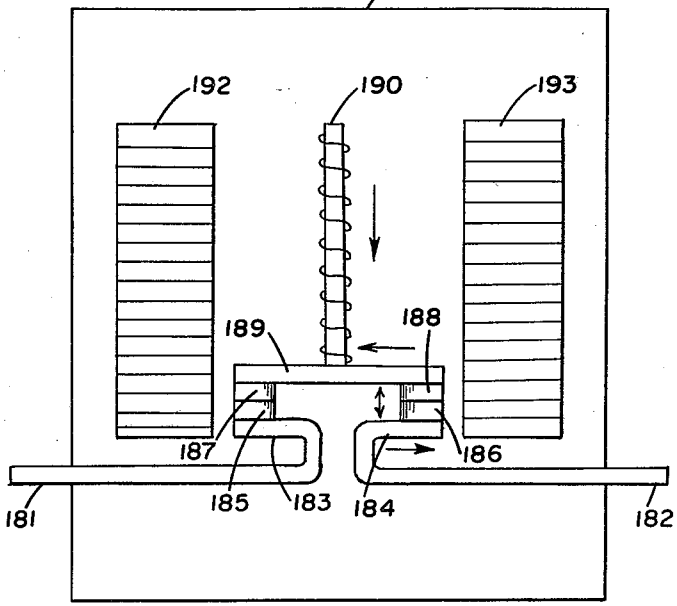
FIG. 5 schematically illustrates a second version of the novel auxiliary contact of the present invention.

Another version of an adapter which inherently contains two additional breaks is schematically illustrated in FIG. 5 and consists of a separate housing 180 having terminals 181 and 182 which extend inwardly of the housing 180 and are reentrantly bent at reentrant sections 183 and 184, respectively, where they receive stationary contacts 185 and 186, respectively. Contacts 185 and 186 receive the cooperating contacts 187 and 188 of a bridging contact 189 which is guided for motion on a guide rod 190 which is stationarily mounted within the housing 180 and is pressed toward engagement with contacts 185 and 186 by the compression spring 191 guided by the rod 190.

Two arc chutes, schematically illustrated as the arc chutes 192 and 193, are then disposed to cooperate with contacts 185-187 and 186-188 such that arcs drawn between these contacts when the movable contact bridge 189 moves upwardly will be blown into their respective arc chutes.

The assembly of FIG. 5 may be connected in series, for example at the terminal 181, with the terminals of a conventional current-limiting circuit breaker, such as the circuit breaker 20 of FIG. 2. This reentrant bend paths of sections 183 and 184 will produce a magnetic blow off force on the bridge 189 since the current paths of sections 183 and 184 are opposite to the current paths of the parallel sections of bridge 189. Consequently, when the current is of fault current magnitude, the force created will overcome the force of the compression spring 191, therey to drive the bridge 189 upwardly and thus open the contacts 185-187 and 186-188. The arcs drawn between the separating contacts will be extinguished in the arc chutes 192 and 193 and the arc voltage drop on these two arcs will be in series with the arc voltage drop of the main circuit interrupter 120.

After the circuit has been successfully interrupted, spring 191 will cause reclosing of contacts 185-187 and 186-188 without the need for the reset of any latch or operation of any manual member. The interrupter assembly can then be appropriately reset by the reset of the breaker 20.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A current-limiting circuit breaker assembly comprising, in combination: a first circuit breaker having a first pair of contacts, a first arc interruption chamber associated with said first pair of contacts, a contact operating mechanism having a manual operating mechanism connected to said first pair of contacts and automatic trip means connected to said first pair of contacts to open said first pair of contacts in response to a fault current, said first pair of contacts being disposed to have oppositely directed current paths of substantial length to produce a magnetic blow open force on said first pair of contacts to cause them to open independently of said contact operation mechanism, and a second circuit breaker comprising a second pair of contacts connected in series with said first pair of contacts, a second arc interruption chamber associated with said second pair of contacts and biasing means connected to said second pair of contacts to normally close said second pair of contacts; said second pair of contacts being disposed to have oppositely directed current paths of substantial length to produce a magnetic blow open force to open said second pair of contacts against the force of said biasing means when the current through said second pair of contacts exceeds a given value; said circuit breaker assembly being contained in a common housing.

2. The device of claim 1 wherein said manual operating mechanism is the sole manual operating mechanism for said circuit breaker assembly.

3. The device of claim 1 wherein said housing is an insulating housing including first and second sections, said first and second circuit breakers each being contained in one of said first and second sections.

4. The device of claim 1 wherein said second pair of contacts is free of latch-open means and is immediately reclosed when the magnetic blow open force reduces below the biasing force of said biasing means and after said first pair of contacts has opened.

5. The device of claim 1 further including a third pair of contacts connected in series with said first and second pairs of contacts, a third arc interruption chamber associated with said third pair of contacts and biasing means connected to said third pair of contacts to normally close said third pair of contacts; said third pair of contacts being disposed to have oppositely directed current paths of substantial length to produce a magnetic blow open force to open said third pair of contacts against the force of said biasing means when the current through said third pair of contacts exceeds a given value.

6. The device of claim 5 wherein each of said second and third pairs of contacts includes a stationary contact and a movable contact, said movable contacts of said second and third pairs of contacts being connected by a bridging contact, said biasing means being connected to said bridging contact to normally close said second and third pairs of contacts simultaneously.

* * * * *

UNITED STATES PATENT AND TRADEMARK OFFICE

CERTIFICATE OF CORRECTION

PATENT NO. : 4,346,357

DATED : August 24, 1982

INVENTOR(S) : Kussy et al.

It is certified that error appears in the above-identified patent and that said Letters Patent are hereby corrected as shown below:

In column 2, line 56, please change "prior" to --motor--;

In column 4, line 31, please change "contractor" to --contactor--;

In column 6, line 36, please change "This" to --The--; and

In column 6, line 43, please change "therey" to --thereby--.

Signed and Sealed this

Nineteenth Day of October 1982

[SEAL]

Attest:

GERALD J. MOSSINGHOFF

Attesting Officer

Commissioner of Patents and Trademarks